US008251028B2

(12) United States Patent
Ezaki et al.

(10) Patent No.: US 8,251,028 B2
(45) Date of Patent: Aug. 28, 2012

(54) VALVE OPERATING APPARATUS FOR INTERNAL COMBUSTION ENGINE

(75) Inventors: Shuichi Ezaki, Susono (JP); Takashi Nishikiori, Susono (JP); Akio Kidooka, Ashigarakami-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 393 days.

(21) Appl. No.: 12/677,622

(22) PCT Filed: Nov. 5, 2008

(86) PCT No.: PCT/JP2008/070123

§ 371 (c)(1),
(2), (4) Date: Mar. 11, 2010

(87) PCT Pub. No.: WO2010/052769

PCT Pub. Date: May 14, 2010

(65) Prior Publication Data

US 2011/0271917 A1 Nov. 10, 2011

(51) Int. Cl.
*F01L 1/34* (2006.01)

(52) U.S. Cl. ..... 123/90.16; 123/90.39; 74/559

(58) Field of Classification Search ..... 123/90.16, 123/90.39, 90.15; 74/559, 659
See application file for complete search history.

(56) References Cited

U.S. PATENT DOCUMENTS 6,467,444 B2 * 10/2002 Tanaka et al. ..... 123/90.16

FOREIGN PATENT DOCUMENTS

| | | | |
|---|---|---|---|
| JP | 61-093217 | A | 5/1986 |
| JP | 62-184118 | U | 11/1987 |
| JP | 10-008928 | A | 1/1998 |
| JP | 2000-008819 | A | 1/2000 |
| JP | 2003-293714 | A | 10/2003 |
| JP | 2005-042717 | A | 2/2005 |
| JP | 2006-520869 | A | 9/2006 |
| JP | 2006-316664 | A | 11/2006 |

* cited by examiner

*Primary Examiner* — Zelalem Eshete
(74) *Attorney, Agent, or Firm* — Kenyon & Kenyon LLP

(57) ABSTRACT

The present invention makes it possible to favorably change valve-opening characteristics of a valve using a simplified configuration without leading to an increase in the number of components and also without causing an increase of friction due to sliding, in a valve operating apparatus for an internal combustion engine in which the valve-opening characteristics of the valve are variable. A changeover mechanism for switching the connection/disconnection of rocker arms disposed between cams and a valve is provided. When a slide pin reaches a displacement end in the retreating direction of changeover pin, the biasing force of a return spring acting on changeover pins is received by an engaging part between a notch part provided in the slide pin and a lock pin in a state separated from a camshaft.

11 Claims, 8 Drawing Sheets

VALVE OPERATING APPARATUS FOR INTERNAL COMBUSTION ENGINE

This is a 371 national phase application of PCT/JP2008/070123 filed 05 Nov. 2008, the contents of which are incorporated herein by reference.

TECHNICAL FIELD

The present invention relates to a valve operating apparatus for an internal combustion engine, and particularly to a valve operating apparatus for an internal combustion engine in which valve-opening characteristics of a valve are variable.

BACKGROUND ART

Previously, for example, Patent Document 1 discloses a valve operating mechanism of an internal combustion engine in which a cam carrier provided with two kinds of cams is provided for each cylinder, and the cam carrier is moved in the axial direction with respect to a cam main-shaft which is rotated so that valve drive cams for each cylinder are switched. To be more specific, in this conventional valve operating mechanism, guide grooves which are formed into a helical shape are provided respectively in both ends of the outer peripheral surface of each cam carrier. Moreover, an electric actuator, which drives a drive pin to be inserted into or removed from the guide groove, is provided for each guide groove.

According to the above-described conventional valve operating mechanism, the cam carrier can be moved with respect to the axial direction by inserting the drive pin to the guide groove, and thus the lift amounts of valves can be changed by switching the valve drive cams of each cylinder. Moreover, the above-described conventional valve operating mechanism is provided with a holding mechanism for holding the axial position of the cam carrier without the drive pin being inserted into the guide groove. To be more specific, such holding mechanism is implemented by providing a ball, which is biased toward the radial direction of the cam main-shaft by a spring, in the cam main-shaft and fitting a part of the ball into a tapered surface formed in the inner peripheral surface of the cam carrier.

[Patent Document 1] National Publication of International Patent Application No. 2006-520869

DISCLOSURE OF THE INVENTION

Problem to be Solved by the Invention

As described above, in the above-described conventional valve operating mechanism, an arrangement is made such that the holding mechanism for holding the axial position of the cam carrier without the drive pin being inserted into the guide groove is separately provided for the mechanism for switching the axial position of the cam carrier. As a result of this, a problem existed in that the number of components is relatively large.

Further, in the configuration of the above-described conventional holding mechanism, when releasing the hold of the axial position of the cam carrier by the ball and tapered surface to control the axial position of the cam carrier into the opposite direction to the previous time, a force to release the engagement between the ball and the tapered surface (a force to make the ball retreat into the cam main-shaft) is needed. In such an occasion, in the above-described conventional valve operating mechanism, an arrangement is made such that the guide groove and the drive pin which are not used in the previous time are used to release the hold of the axial position of the cam carrier. That is, the above-described conventional configuration needs to include the guide groove and the drive pin at both ends of the cam carrier in the aspect of obtaining the force to release the hold as well, which is also a factor to increase the number of components.

The present invention has been made to solve the problem as described above, and has its object to provide a valve operating apparatus for the an internal combustion engine which can favorably change its valve-opening characteristics of a valve using a simplified configuration without leading to an increase in the number of components and also without causing an increase of friction due to sliding, in the valve operating apparatus for the internal combustion engine in which the valve-opening characteristics of the valve is variable.

Means for Solving the Problem

A first aspect of the present invention is a valve operating apparatus for an internal combustion engine, the apparatus comprising:

a variable mechanism which is disposed between a cam and a valve, includes a plurality of transfer members for transferring an acting force of the cam to the valve, and changes valve-opening characteristics of the valve as the plurality of transfer members are connected/disconnected to/from each other; and changeover means which switches the connection/disconnection of the plurality of transfer members, wherein the changeover means includes:

a changeover pin which is advanceably and retreatably attached to the variable mechanism and makes the plurality of transfer members connected to or disconnected from each other;

biasing means which biases the changeover pin in an advancing direction thereof; and a pin driving mechanism which includes a displacement member that is displaceable in association with a advancing/retreating operation of the changeover pin and receives a biasing force exerted by the biasing means via the changeover pin, wherein the pin driving mechanism displaces the changeover pin in a retreating direction thereof via the displacement member with an aid of a rotational force of the cam, and wherein the pin driving mechanism further includes a receiving part which receives a biasing force of the biasing means acting on the changeover pin, in a state of being separated from a rotating body which rotates in association with the cam, when the displacement member has reached a displacement end in the retreating direction of the changeover pin.

A second aspect of the present invention is the valve operating apparatus for the internal combustion engine according to the first aspect of the present invention, wherein the plurality of transfer members includes a first oscillation member which is caused to oscillate by the cam, and a second oscillation member which oscillates in association with the valve, and wherein the changeover pin is advanceably and retreatably supported by one of the first oscillation member and the second oscillation member, and is inserted into and taken out from an engaging hole provided in the other of the first oscillation member and the second oscillation member.

A third aspect of the present invention is the valve operating apparatus for the internal combustion engine according to the first or the second aspect of the present invention, wherein the pin driving mechanism further includes:

a helical groove which is formed in an outer peripheral surface of the rotating body which rotates in association with the cam and guides a displacement of the displacement member;

a projection part which is provided in the displacement member and is insertable into and removable from the helical groove; and insertion control means which includes a fixed part fixed to a stationary member of the internal combustion engine, and an abutment part abuttable to the displacement member, and inserts the projection part into the helical groove by abutting the abutment part to the displacement member, and wherein the receiving part is provided between the displacement member and the abutment part.

A fourth aspect of the present invention is the valve operating apparatus for the internal combustion engine according to the third aspect of the present invention, wherein the projection part moves away from the rotating body in response to engagement between the displacement member and the abutment part when the displacement member reaches the displacement end.

A fifth aspect of the present invention is the valve operating apparatus for the internal combustion engine according to the third or the fourth aspect of the present invention, wherein the abutment part is an abutment pin which is abuttable to the displacement member, wherein the displacement member includes a notch part which is positioned opposed to the abutment pin when the displacement member reaches the displacement end, and wherein the receiving part is an engaging part between the abutment pin and the notch part.

A sixth aspect of the present invention is the valve operating apparatus for the internal combustion engine according to any one of the third to fifth aspects of the present invention, wherein the helical groove includes a shallow groove part in which a depth of the helical groove gradually decreases as the rotating body rotates after the displacement member, which is guided by the helical groove, reaches the displacement end.

A seventh aspect of the present invention is the valve operating apparatus for the internal combustion engine according to the sixth aspect of the present invention, wherein the shallow groove part is arranged such that at least a partial section from a terminal end of the shallow groove part or an entire section of the shallow groove part is positioned within a non-base-circle section of the cam.

An eighth aspect of the present invention is the valve operating apparatus for the internal combustion engine according to the sixth aspect of the present invention, wherein the shallow groove part is arranged such that a terminal end of the shallow groove part corresponds to a base circle section of the cam.

A ninth aspect of the present invention is the valve operating apparatus for the internal combustion engine according to the fifth aspect of the present invention, wherein a sectional shape of a contact part of the notch part which is in contact with the abutment pin has an R-shape section which is convex toward the abutment pin side.

A tenth aspect of the present invention is the valve operating apparatus for the internal combustion engine according to the fifth or the ninth aspect of the present invention, wherein the abutment pin is formed into a tapered shape which becomes thinner toward a distal end thereof.

An eleventh aspect of the present invention is the valve operating apparatus for the internal combustion engine according to the ninth or the tenth aspect of the present invention, wherein the contact part engages with a non-tapered part of the abutment pin when a state in which the biasing force exerted by the biasing means is received between the contact part and the abutment pin is held and, on the other hand, the contact part engages with the tapered part of the abutment pin after an operation to release the engagement between the abutment pin and the notch part is started.

Advantages of the Invention

According to the first aspect of the present invention, in a state in which the displacement member for displacing the changeover pin has reached the displacement end in the retreating direction of the changeover pin, it becomes possible to receive the changeover pin, which is biased in the advancing direction, in a state of being separated from the rotating body, which rotates in association with the cam, and hold the axial position of the changeover pin. Moreover, according to the present invention, it becomes possible to hold the axial position of the concerned changeover pin by the pin driving mechanism without the need of separately providing the mechanism for holding the axial position of the changeover pin (that is, the control position of the valve-opening characteristics of the valve). As a result of this, according to the present invention, it becomes possible to favorably change the valve-opening characteristics of the valve using a simplified configuration without leading to an increase in the number of components and also without causing an increase of friction due to sliding.

According to the second aspect of the present invention, in a configuration in which the first oscillation member which is caused to oscillate by the cam and the second oscillation member which pivots in association with the valve are provided and the connected state or the disconnected state of these oscillation members is switched by a changeover pin, it becomes possible to favorably change the valve-opening characteristics of the valve by using a simplified configuration without leading to an increase in the number of components and also without causing an increase of friction due to sliding.

According to the third aspect of the present invention, in a configuration in which the helical groove formed in the rotating body and the projection part which is provided in the displacement member and is insertable into and removable from the helical groove are provided, it becomes possible to receive the changeover pin, which is biased to the advancing direction, in a state of being separated from the rotating body which rotates in association with the cam, with the aid of the abutment member for inserting the projection part into the helical groove and the displacement member, thereby holding the axial position of the changeover pin.

According to the fourth aspect of the present invention, it becomes possible to make the projection part separated from the rotating body in order to avoid the friction due to the sliding by performing the operation to engage the displacement member with the abutment member.

According to the fifth aspect of the present invention, by utilizing the engagement between the abutment pin abuttable to the displacement member and the notch part provided in the displacement member, it becomes possible to hold the axial position of the changeover pin by using a sufficiently simplified configuration without leading to an increase in the number of components.

According to the sixth aspect of the present invention, it becomes possible to detach the projection part from the helical groove with the aid of the rotational force of the cam without the need of other power as a result of the projection part being guided by the shallow groove part as the rotating body rotates, in a state in which the displacement member has reached the displacement end.

According to the seventh aspect of the present invention, it becomes possible to securely avoid the projection part from being disengaged from the shallow groove part due to the biasing force from the biasing means even when the depth of the groove gradually decreases in the course of the projection part passing through the shallow groove part, by taking advantage of the section in which the biasing force of the biasing means is not transferred (or less prone to being transferred) to the displacement member. This makes it possible to favorably ensure the control stability of the valve-opening characteristics of the valve.

According to the eighth aspect of the present invention, since the projection part can be taken out from the helical groove within the base circle section of the cam in which a plurality of the transfer members are in a stationary state, it becomes possible to discontinue the operation to displace the changeover pin in its retreating direction within the base circle section in which the operation is performed. As a result of this, according to the present invention, when a request is issued to cancel a change request of the valve-opening characteristics of the valve immediately after the same request is issued, it becomes possible to quickly cancel the above-described change request without resulting in a change of the valve-opening characteristics of the valve.

According to the ninth aspect of the present invention, since the contact between the contact part and the abutment pin becomes a point contact, it becomes possible to reduce the friction when withdrawing the abutment pin. As a result of this, it becomes possible to favorably ensure responsiveness when withdrawing the abutment pin, and also to reduce the variation of response.

According to the tenth aspect of the present invention, it becomes possible to assist the operation to withdraw the abutment pin in its retreating direction with the aid of the load of the displacement member which is subjected to the biasing force of the biasing means. This makes it possible to favorably improve the responsiveness when withdrawing the abutment pin.

According to the eleventh aspect of the present invention, when holding the state in which the abutment pin is engaged with the notch part, it becomes possible to reduce the power needed to maintain the holding operation compared to the case in which the contact part is kept in contact with the tapered part at the time of the holding operation, and also becomes possible to quickly withdraw the abutment pin by using the tapered part after the operation to release the engagement between the abutment pin and the notch part is started.

DESCRIPTION OF SYMBOLS

Figure 1:
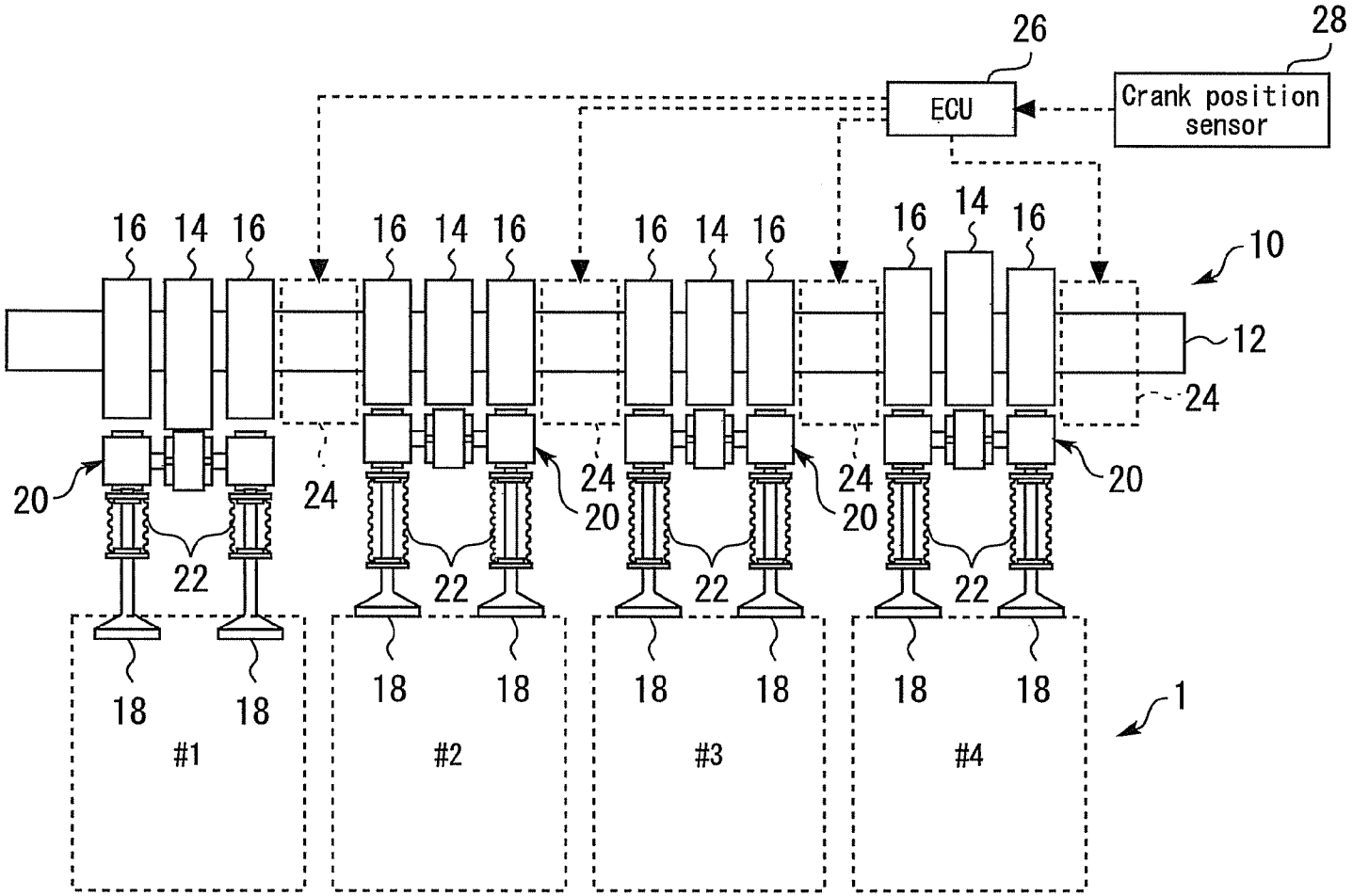
FIG. 1 is a schematic diagram showing the overall configuration of a valve operating apparatus for an internal combustion engine according to a first embodiment of the present invention.

1 internal combustion engine
10 valve operating apparatus
12 camshaft
14 main cam
14*a* base circle part
14*b* nose part
16 auxiliary cam
18 valve
20 variable mechanism
22 valve spring
24 changeover mechanism
26 ECU (Electronic Control Unit)
28 crank position sensor
30 rocker shaft
32 first rocker arm
34L, 34R second rocker arm
36 first roller
38 coil spring
40 second roller
42 rush adjuster
44 first spindle
46 first pin hole
48 first changeover pin
50L, 50R second spindle
52L, 52R second pin hole
54L, 54R second changeover pin
56 return spring
58, 90 slide pin
58*a* circular column part
58*b* arm part
58*c* projection part
58*d* pressing surface
58*e*, 90*e* notch part
58*f* guide surface

60 support member
62 large diameter part
64, 80 helical groove
64*a*, 80*a* proximal end
64*b*, 80*b* terminal end
64*c*, 80*c* shallow groove part
66 actuator
68 solenoid
68*a* drive axis
70, 92 lock pin
72 spring
74 support member
76 stopper
78 spring
90*g* contact part
92*a* tapered part
92*b* straight part
Pmax1, Pmax2 displacement end

BEST MODE FOR CARRYING OUT THE INVENTION

First Embodiment

First, a first embodiment of the present invention will be described with reference to FIGS. 1 to 11.

[Overall Configuration of Valve Operating Apparatus]

FIG. 1 is a schematic diagram showing the overall configuration of a valve operating apparatus 10 for an internal combustion engine 1 according to the first embodiment of the present invention.

Here, the internal combustion engine 1 is supposed to be a straight 4-cylinder engine having four cylinders (#1 to #4) in which the combustion stroke take places in the order from #1 to #3, to #4, and to #2. Moreover, suppose that two intake valves and two exhaust valves are provided in each cylinder of the internal combustion engine 1. Thus, it is supposed that the configuration shown in FIG. 1 functions as a mechanism to drive two intake valves or two exhaust valves disposed in each cylinder.

The valve operating apparatus 10 of the present embodiment includes a camshaft 12. The camshaft 12 is connected to a crankshaft, which is not shown, by means of a timing chain or a timing belt and is configured to rotate at a half speed of that of the crankshaft. The camshaft 12 is formed with a main cam 14 and two auxiliary cams 16 for one cylinder. The main cam 14 is disposed between two auxiliary cams 16.

The main cam 14 includes an arc-shaped base circle part 14*a* (see FIG. 3) concentric with the camshaft 12, and a nose part 14*b* (see FIG. 3) which is formed such that a part of the base circle expands outwardly in the radial direction. Moreover, in the present embodiment, the auxiliary cam 16 is configured to be a cam which includes only a base circle part (a zero lift cam) (see FIG. 4).

A variable mechanism 20 is interposed between the cam 14, 16 and the valve 18 of each cylinder. That is, the acting forces of the cams 14 and 16 are arranged to be transferred to the two valves 18 via the variable mechanism 20. The valve 18 is adapted to be opened and closed by use of the acting force of the cams 14 and 16, and the biasing force of valve spring 22. Note that the state shown in FIG. 1 represents a state in which the valve 18 of the cylinder #1 is opened by being subjected to the acting force of the main cam 14.

The variable mechanism 20 is a mechanism to change the valve-open characteristics of the valve 18 by switching between the state in which the acting force of the main cam 14 is transferred to the valve 18 and the state in which the acting force of the auxiliary cam 16 is transferred to the valve 18. Note that, in the present embodiment, since the auxiliary cam 16 is a zero-lift cam, the state in which the acting force of the auxiliary cam 16 is transferred to the valve 18 refers to a state in which neither opening nor closing of the valve 18 take place (a valve halted state).

Moreover, the valve operating apparatus 10 of the present embodiment includes, for each cylinder, a changeover mechanism 24 for driving each variable mechanism 20 to switch the valve opening characteristics. The changeover mechanism 24 is adapted to be driven according to a driving signal from an ECU (Electronic Control Unit) 26. The ECU 26, which is an electronic control unit for controlling the operating state of the internal combustion engine 1, controls the changeover mechanism 24 based on the output signal of a crank position sensor 28 and the like. The crank position sensor 28 is a sensor for detecting a rotational speed of the output shaft (crankshaft) of the internal combustion engine 1.

[Configuration of Variable Mechanism]

Next, a detailed configuration of the variable mechanism 20 will be described with reference to FIGS. 2 to 4.

Figure 2:
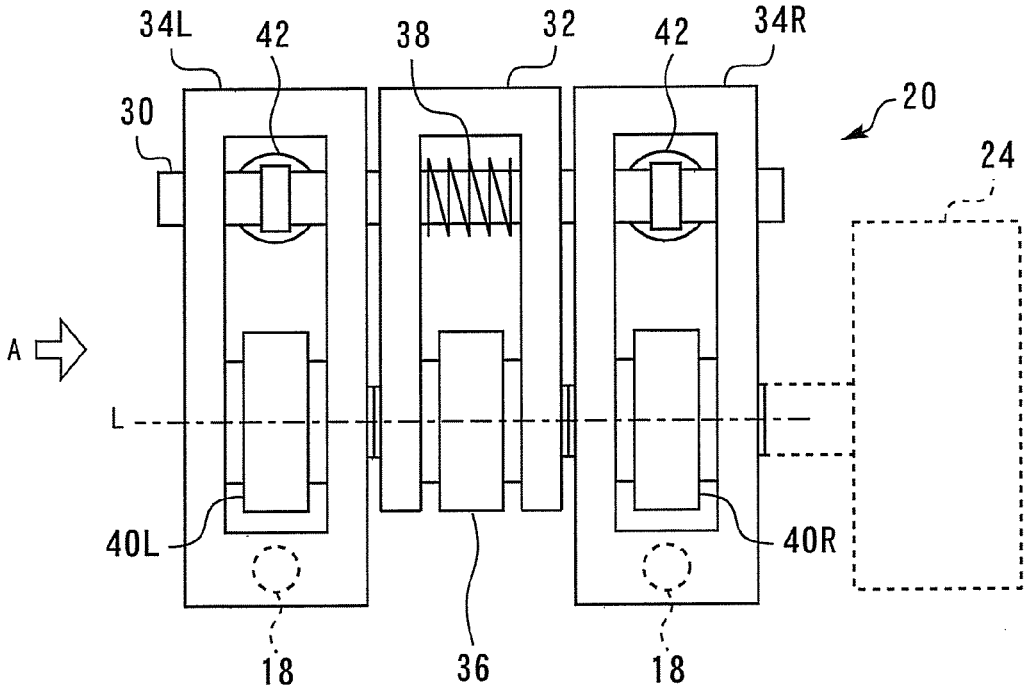
FIG. 2 is a look-down view of the variable mechanism shown in FIG. 1 seen from the proximal end part side of the valve.

FIG. 2 is a look-down view of the variable mechanism 20 shown in FIG. 1 seen from the proximal end part side of the valve 18.

The variable mechanism 20 includes a rocker shaft 30 which is disposed in parallel with the camshaft 12. As shown in FIG. 2, a first rocker arm 32 and a pair of second rocker arms 34R and 34L are rotatably attached to the rocker shaft 30. The first rocker arm 32 is disposed between the two second rocker arms 34R and 34L. Note that, in the present description, the right and left second rocker aims 34R and 34L may be referred to simply as a second rocker arm 34 when they are not particularly discriminated.

Figure 3:
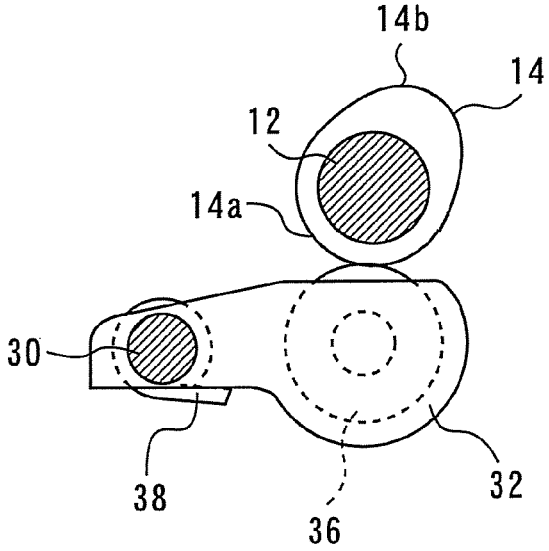
FIG. 3 is a view of a first rocker arm seen from the axial direction (the direction shown by an arrow A in FIG. 2) of a rocker shaft.
Figure 4:
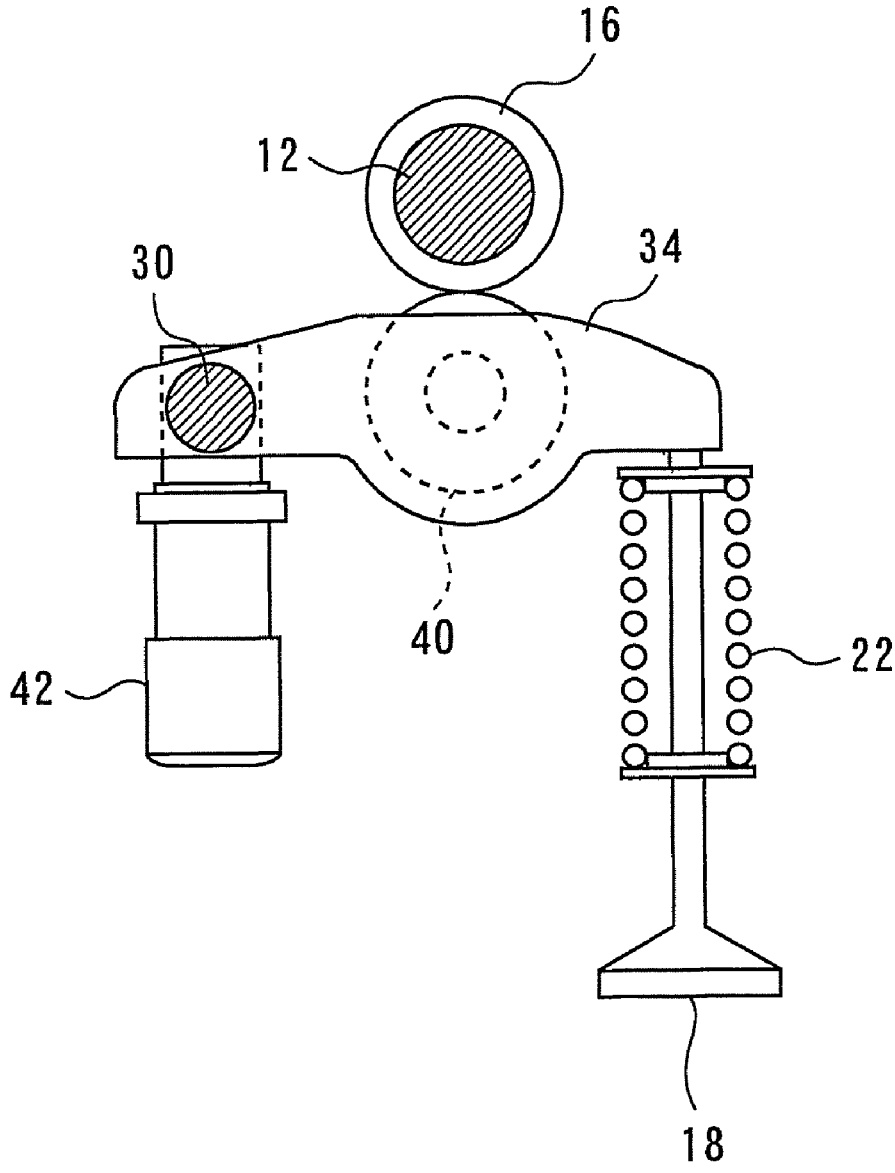
FIG. 4 is a view of a second rocker arm seen from the axial direction (the direction shown by the arrow A) of the rocker shaft in the same manner as in FIG. 3.

FIG. 3 is a view of the first rocker arm 32 seen from the axial direction (the direction shown by an arrow A in FIG. 2) of the rocker shaft 30, and FIG. 4 is a view of the second rocker arm 34 seen from the axial direction (the direction shown by the arrow A) of the rocker shaft 30 in the same manner as in FIG. 3.

As shown in FIG. 3, a first roller 36 is rotatably attached to the end part opposite to the rocker shaft 30 in the first rocker arm 32 at a position which allows a contact with the main cam 14. The first rocker arm 32 is biased by a coil spring 38 attached to the rocker shaft 30 such that the first roller 36 is constantly in abutment with the main cam 14. The first rocker arm 32 configured as described above oscillates with the rocker shaft 30 as a fulcrum through the cooperation between the acting force of the main cam 14 and the biasing force of the coil spring 38.

On the other hand, as shown in FIG. 4, the proximal end part of the valve 18 (specifically, the proximal end part of the valve stem) is in abutment with the end part opposite to the rocker shaft 30 in the second rocker arm 34. Moreover, a second roller 40 is rotatably attached to a central portion of the second rocker arm 34. Note that the outer diameter of the second roller 40 is equal to the outer diameter of the first roller 36.

Moreover, it is supposed that the rocker shaft 30 is supported by a cam carrier (or, for example, a cylinder head), which is a stationary member of the internal combustion engine 1, via a rush adjuster 42 at the other end of the second rocker arm 34. Therefore, the second rocker arm 34 is biased toward the auxiliary cam 16 by being subjected to an upward force from the rush adjuster 42. Note that when the auxiliary cam is a lift cam including a nose part unlike a zero lift cam of the present embodiment, the second rocker arm 34 is pressed against the auxiliary cam by the valve spring 22 while the auxiliary cam lifts up the valve 18.

Further, the position of the second roller 40 with respect to the first roller 36 is defined such that the axial center of the second roller 40 and the axial center of the first roller 36 are positioned on the same straight line L as shown in FIG. 2, when the first roller 36 is in abutment with the base circle part 14*a* of the main cam 14 (see FIG. 3) and the second roller 40 is in abutment with the base circle part of the auxiliary cam 16 (see FIG. 4).

[Configuration of Changeover Mechanism]

Next, a detailed configuration of the changeover mechanism 24 will be described with reference to FIGS. 5 to 7.

The changeover mechanism 24, which is a mechanism for switching the connection/disconnection concerning the first rocker arm 32 and the second rocker arm 34, makes it possible to switch the valve-open characteristics of the valve 18 by switching the state in which the acting force of the main cam 14 is transferred to the second rocker arm 34 and the state in which the forgoing acting force is not transferred to the second rocker arm 34.

Figure 5:
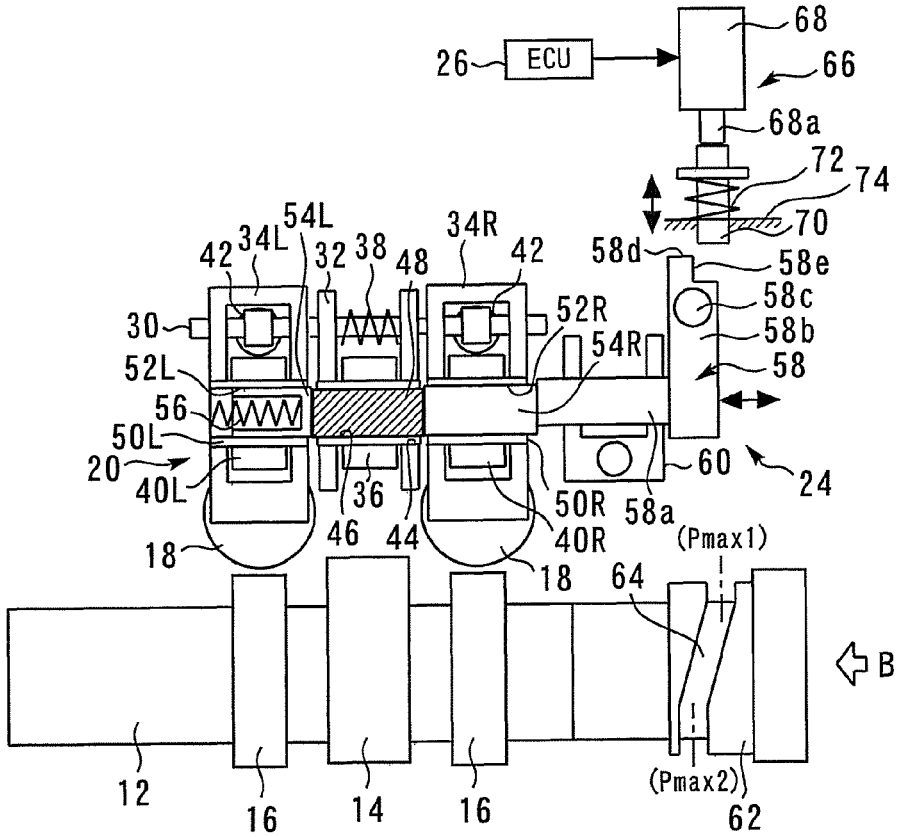
FIG. 5 is a diagram illustrating a detailed configuration of the changeover mechanism shown in FIG. 1.

FIG. 5 is a diagram illustrating a detailed configuration of the changeover mechanism 24 shown in FIG. 1. Note that, in FIG. 5, the variable mechanism 20 is represented by using a section taken at the axial centers of the rollers 36 and 40. Moreover, for the sake of simplicity of description, the mounting position of the camshaft 12 with respect to the mounting position of the variable mechanism 20 is represented in a state different from the actual mounting position excepting the axial position of the camshaft 12.

As shown in FIG. 5, a first pin hole 46 is formed within the spindle 44 of the first roller so as to pass through in its axial direction, and the both ends of the first pin hole 46 are opened to both side surfaces of the first rocker arm 32. A first changeover pin 48 having a circular column shape is slidably inserted into the first pin hole 46. The outer diameter of the first changeover pin 48 is substantially equal to the inner diameter of the first pin hole 46, and the axial length of the first changeover pin 48 is substantially equal to the length of the first pin hole 46.

On the other hand, there is formed inside the spindle 50L of the second roller 40 of the second rocker aim 34L side, a second pin hole 52L of which end part opposite to the first rocker arm 32 is closed and of which end part of the first rocker arm 32 side is opened. Moreover, inside the spindle 50R of the second roller 40 of the second rocker arm 34R side, a second pin hole 52R is formed so as to pass through in its axial direction, and both ends of the second pin hole 52R are opened to the both side surfaces of the second rocker arm 34R. The inner diameters of the second pin holes 52R and 52L are equal to the inner diameter of the first pin hole 46.

A second changeover pin 54L of a circular column shape is slidably inserted into the second pin hole 52L. Moreover, inside the second pin hole 52L, there is disposed a return spring 56 which biases the second changeover pin 54L toward the first rocker arm 32 direction (hereafter, referred to as the "advancing direction of changeover pin"). The outer diameter of the second changeover pin 54L is substantially equal to the inner diameter of the second pin hole 52L. Moreover, the axial length of the second changeover pin 54L is arranged to be shorter than that of the second pin hole 52L, and an adjustment is made such that the distal end of the second changeover pin 54L slightly protrudes from the side surface of the second rocker arm 34L with the second changeover pin 54L being pressed toward inside the second pin hole 52L. Further, it is supposed that the return spring 56 is configured to, in a mounted state, constantly bias the second changeover pin 54L toward the first rocker arm 32.

A second changeover pin 54R of a circular column shape is slidably inserted into the second pin hole 52R. The outer diameter of the second changeover pin 54R is substantially equal to the inner diameter of the second pin hole 52R, and the axial length of the second changeover pin 54R is substantially equal to the length of the second pin hole 52R.

The relative positions of three pin holes 46, 52L, and 52R described so far are defined such that the axial centers of the three pin holes 46, 52L, and 52R are positioned on the same straight line L, when the first roller 36 is in abutment with the base circle part 14*a* of the main cam 14 (see FIG. 3) and the second roller 40 is in abutment with the base circle part of the auxiliary cam 16 (see FIG. 4).

Figure 6:
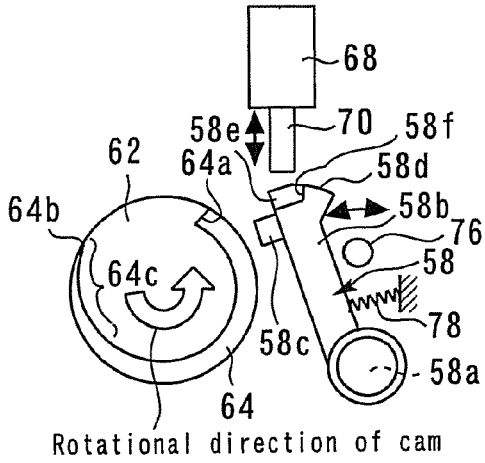
FIG. 6 is a view of the changeover mechanism seen from the axial direction of a camshaft (the direction of an arrow B in FIG. 5)

Here, newly referring to FIG. 6 as well as above-described FIG. 5, description on the changeover mechanism 24 will be continued. FIG. 6 is a view of the changeover mechanism 24 seen from the axial direction of the camshaft 12 (the direction of an arrow B in FIG. 5). Note that in the figures following FIG. 6, the relation between a rock pin 70 and a solenoid 68 is illustrated in a simplified form.

The changeover mechanism 24 includes a slide pin 58 for forcing the changeover pins 48, 54L, and 54R to be displaced toward the second rocker arm 34L side (in the retreating direction of the changeover pin) with the aid of the rotational force of the cam. The slide pin 58 includes, as shown in FIG. 5, a circular column part 58*a* having a end face which is in abutment with the end face of the second changeover pin 54R. The circular column part 58*a* is supported by a support member 60 fixed to the cam carrier so as to be advanceable/retreatable in the axial direction and rotatable in the circumferential direction.

The distal end of the second changeover pin 54L is pressed against one end of the first changeover pin 48 by the biasing force (repulsive force) of the return spring 56. Accordingly, under a situation where the three axial centers of the above-described three pin holes 46, 52L, and 52R are positioned on the same straight line, the other end of the first changeover pin 48 is pressed against one end of the second changeover pin 54R. Further, the other end of the second changeover pin 54R is pressed against an end surface of the circular column part 58*a* of the slide pin 58. Thus, under the above-described specific situation, the arrangement is made such that a biasing force of the return spring 56 acts on the slide pin 58. Note that the shape and size of each component is specified such that the abutment between the second changeover pin 54R and the circular column part 58*a* is not interrupted when the second rocker arm 34R oscillates by being subjected to an acting force from the main cam 14.

Moreover, a bar-like arm part 58*b* is provided so as to protrude outwardly in the radial direction of the circular column part 58*a* at the end part opposite to the second changeover pin 54R in the circular column part 58*a*. That is, the arm part 58*b* is configured to be rotatable around the axial center of the circular column part 58*a*. The distal end part of the arm part 58*b* is configured, as shown in FIG. 6, to extend up to a position opposed to the peripheral surface of the camshaft 12. Moreover, a projection part 58*c* is provided at the distal end part of the arm part 58*b* so as to protrude toward the peripheral surface of the camshaft 12.

There is formed in the outer peripheral surface opposed to the projection part 58*c* in the camshaft 12, a large-diameter part 62 having a larger diameter than that of the camshaft 12. There is formed in the peripheral surface of the large-diameter part 62 a helical groove 64 extending in the circumferential direction. The width of the helical groove 64 is formed to be slightly larger than the outer diameter of the projection part 58*c*.

Moreover, the changeover mechanism 24 includes an actuator 66 for inserting the projection part 58*c* into the helical groove 64. To be more specific, the actuator 66 includes a solenoid 68 which is duty controlled based on the command from the ECU 26 and a lock pin 70 which is in abutment with the drive axis 68*a* of the solenoid 68. The lock pin 70 is formed into a cylindrical shape.

One end of the spring 72, which exerts a biasing force against the thrust of the solenoid 68, is fixedly engaged to the lock pin 70 and the other end of the spring 72 is fixedly engaged to a support member 74 fixed to the cam carrier which is a stationary member. According to such configuration, when the solenoid 68 is driven based on the command from the ECU 26, the lock pin 70 can be advanced as a result of the thrust of the solenoid 68 overpowering the biasing force of the spring 72 and, on the other hand, when the driving of the solenoid 68 is stopped, the lock pin 70 and the driving shaft 68*a* can be quickly retreated to a predetermined position by the biasing force of the spring 72. Moreover, the lock pin 70 is restricted from moving in its radial direction by the support member 74. As a result, even when the lock pin 70 is subjected to a force from its radial direction, the lock pin 70 can be prevented from moving in the abovementioned direction.

Moreover, it is supposed that the solenoid 68 is fixed to a stationary member such as a cam carrier, at a position where the lock pin 70 can press the pressing surface (the surface opposite to the surface where the projection part 58*c* is provided) 58*d* of the distal end part of the arm part 58*b* of the slide pin 58 against the helical groove 64. In other words, the pressing surface 58*d* is provided in a shape and at a position where the projection part 58*c* can be pressed toward the helical groove 64 by the lock pin 70.

The arm part 58*b* of the slide pin 58 is arranged to be rotatable around the axial center of the circular column part 58*a* within a range restricted by the large-diameter part 62 of the camshaft 12 side and a stopper 76. Then, the positional relationship of each component is arranged such that when the arm part 58*b* is within the abovementioned range, and when the axial position of the slide pin 58 is at a displacement end Pmax1 described later, the lock pin 70 driven by the solenoid 68 can come into abutment with the pressing surface 58*d* of the arm part 58*b* securely. Moreover, attached to the arm part 58*b* is a spring 78 which biases the arm part 58*b* toward the stopper 76. Note that such spring 78 may not necessarily be provided such as when it is not assumed that the arm part 58*b* may fit into the helical groove 64 by the self-weight of the slide pin 58 while the solenoid 68 is not driven.

The helical direction in the helical groove 64 of the camshaft 12 is arranged such that when the camshaft 12 is rotated in a predetermined rotational direction shown in FIG. 6 with the projection part 58*c* being inserted thereinto, the slide pin 58 causes the changeover pins 48, 54L, and 54R to be displaced in the direction approaching the rocker arms 32 and 34 while pushing aside them in the retreating direction against the biasing force of the return spring 56.

Here, the position of the slide pin 58, in a state where the second changeover pin 54L is inserted into both the second pin hole 52L and the first pin hole 46 by the biasing force of the return spring 56, and where the first changeover pin 48 is inserted into both the first pin hole 46 and the second pin hole 52R, is referred to as a "displacement end Pmax1". When the slide pin 58 is positioned at this displacement end Pmax1, the first rocker arm 32 and the second rocker arms 34R and 34L all become connected with each other. Moreover, the position of the slide pin 58 in a state where as a result of the changeover pin 48 and the like being subjected to a force from the slide pin 58, the second changeover pin 54L, the first changeover pin 48, and the second changeover pin 54R are respectively inserted only into the second pin hole 52L, the first pin hole 46, and the second pin hole 52R, is referred to as a "displacement end Pmax 2". That is, when the slide pin 58 is positioned at this displacement end Pmax2, the first rocker arm 32, and the second rocker arms 34R and 34L are all disconnected from each other.

In the present embodiment, the position of the proximal end 64*a* of the helical groove 64 in the axial direction of the camshaft 12 is arranged so as to coincide with the position of the projection part 58*c* when the slide pin 58 is positioned at the above-described displacement end Pmax1. Further, the position of the terminal end 64*b* of the helical groove 64 in the axial direction of the camshaft 12 is arranged so as to coincide with the position of the projection part 58*c* when the slide pin 58 is positioned at the above-described displacement end Pmax2. That is, in the present embodiment, the configuration is made such that the slide pin 58 is displacable between the displacement end Pmax1 and the displacement end Pmax2 within the range in which the projection part 58*c* is guided by the helical groove 64.

Further, as shown in FIG. 6, the helical groove 64 of the present embodiment is provided with a shallow groove part 64*c*, in which the depth of the helical groove 64 gradually decreases as the camshaft 12 rotates, as a predetermined section of the terminal end 64*b* side after the slide pin 58 reaches the displacement end Pmax2. Note that the depth of the portion other than the shallow groove part 64*c* in the helical groove 64 is constant.

Moreover, the arm part 58*b* in the present embodiment is provided with a notch part 58*e* which is formed into a concave shape by notching a part of a pressing surface 58*d*. The pressing surface 58*d* is provided so as to be kept in abutment with the lock pin 70 while the slide pin 58 is displaced from the displacement end Pmax1 to the displacement end Pmax2. Further, the notch part 58*e* is provided in a portion where it can be engaged with the lock pin 70 when the projection part 58*c* is taken out on the surface of the large-diameter part 62 by the action of the above-described shallow groove part 64*c*, in a state where the slide pin 58 is positioned at the above-described displacement end Pmax2.

Moreover, the notch part 58*e* is formed so as to be engaged with the lock pin 70 in a mode in which the rotation of the arm part 58*b* in the direction in which the projection part 58*c* is inserted into the helical groove 64 can be restricted, and the movement of the slide pin 58 in the advancing direction of the changeover pin can be restricted. To be more specific, there is provided in the notch part 58*e*, a guide surface 58*f* which guides the slide pin 58 to move away from the large-diameter part 62 as the lock pin 70 moves into the notch part 58*e*.

[Arrangement of the Range of Helical Groove with Respect to Crank Angle]

Figure 7:
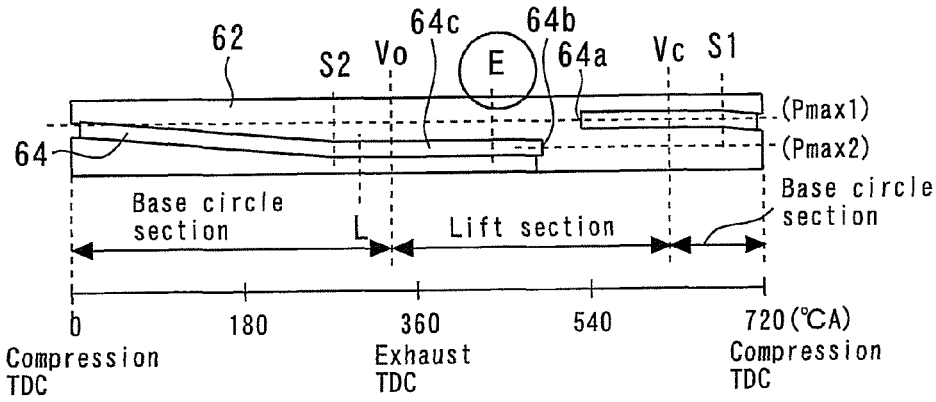
FIG. 7 is a development view of a large-diameter part of the camshaft, in which a helical groove is formed.

FIG. 7 is a development view of the large-diameter part 62 of the camshaft 12, in which the helical groove 64 is formed. To be more specific, FIG. 7 represents each point in the helical groove 64 in correspondence with the crank angle of the internal combustion engine 1. Note that in FIG. 7, the compression top dead center is defined as the crank angle CA of zero degree.

In FIG. 7, a symbol "Vo" indicates an intake valve opening timing and a symbol "Vc" indicates an intake valve closing timing, respectively. Therefore, in a case in which the intake valve is driven by the main cam 14, the base circle section and the lift section of the main cam 14 are as shown in FIG. 7.

Moreover, in FIG. 7, a symbol "S1" indicates a timing at which the displacement of the slide pin 58 in the advancing direction of the changeover pin is started when the projection part 58*c* is inserted into the helical groove 64; and a symbol "S2" indicates a timing at which the displacement of the slide pin 58 in the advancing direction is ended. In the present embodiment, the helical groove 64 is arranged such that such displacement section of the slide pin 58 (the section from S1 to S2) is positioned within the base circle section.

Further, in FIG. 7, a symbol "L" indicates a start timing of the above-described shallow groove part 64*c* from which the depth of the helical groove 64 gradually decreases; and a symbol "E" indicates a timing at which the function, by which the slide pin 58 is held against the biasing force of the return spring 56 by the lock pin 70 being engaged with the notch part 58*e* as a result of the solenoid 68 being driven, has been fully transferred from the helical groove 64 to the lock pin 70.

In the present embodiment, the helical groove 64 is arranged such that, as shown in FIG. 7, a major part from the terminal end 64*b* side in the shallow groove part 64*c*, in which the depth of the helical groove 64 gradually decreases, is positioned not in the base circle section but in the lift section (non-base circle section).

[Operation of the Valve Operating Apparatus of the Present Embodiment]

Next, the operation of the valve operating apparatus 10 will be described with reference to FIGS. 8 to 11.

(At the Time of Normal Lift Operation)

Figure 8:
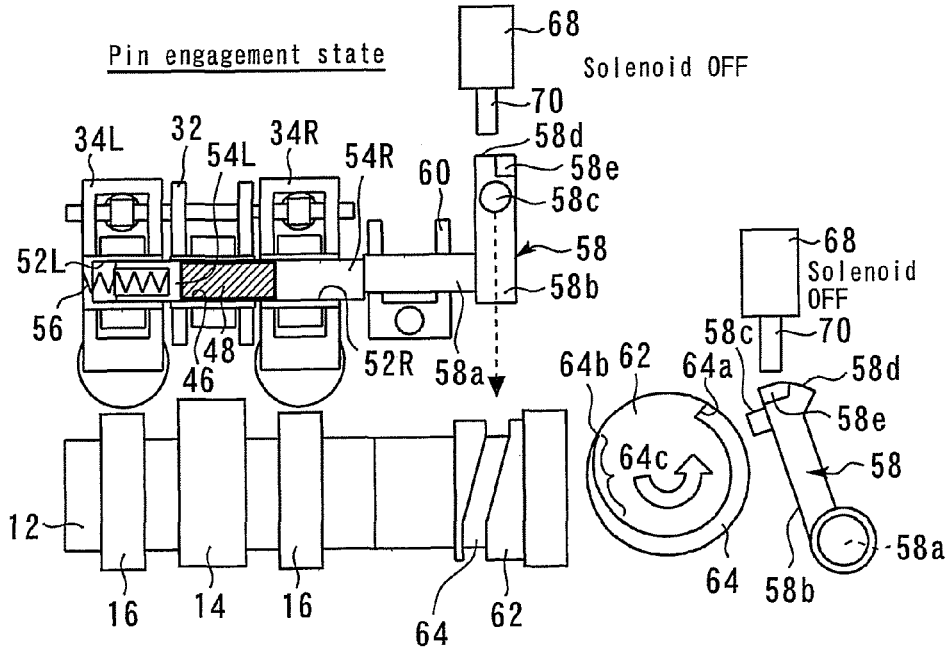
FIG. 8 is a diagram showing a control state during a normal lift operation.

FIG. 8 is a diagram showing a control state during a normal lift operation.

In this case, as shown in FIG. 8(B), the driving of the solenoid 68 is turned OFF and thus the slide pin 58 is positioned at the displacement end Pmax1 being separated from the camshaft 12 and subjected to the biasing force of the return spring 56. In this state, as shown in FIG. 8(A), the first rocker arm 32 and the two second rocker arms 34 are connected via the changeover pins 48 and 54L. As a result of that, the acting force of the main cam 14 is transferred from the first rocker arm 32 to both the valves 18 via the left and right second rocker arms 34R and 34L. Thus, the normal lift operation of the valve 18 is performed according to the profile of the main cam 14.

(At the Start of Valve Stop Operation (the Start of Slide Operation))

Figure 9:
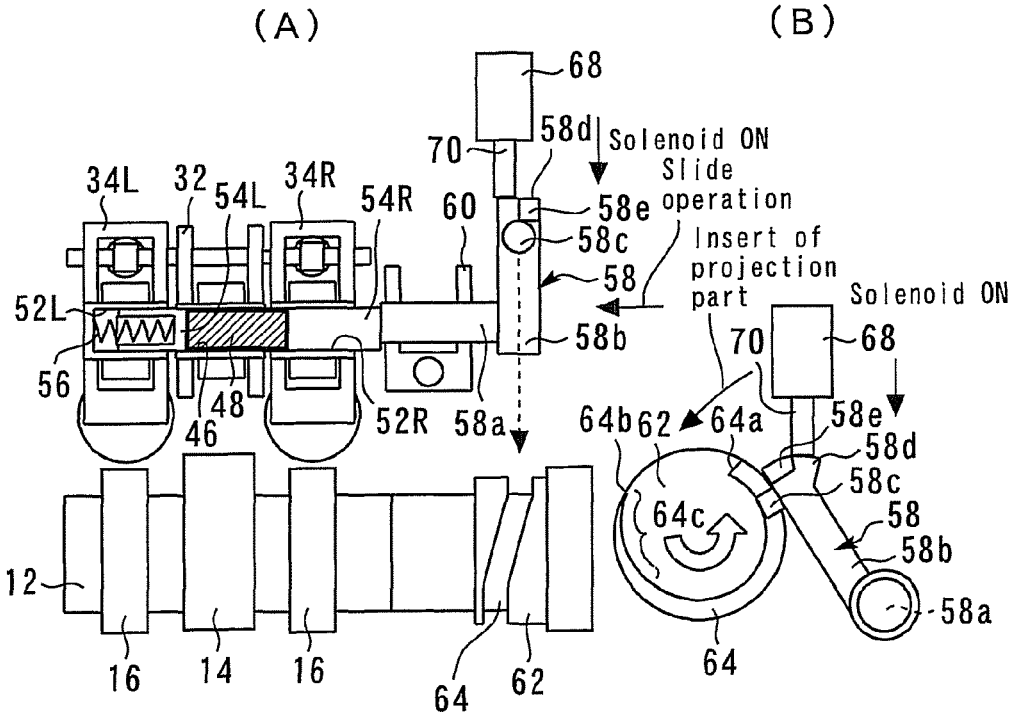
FIG. 9 is a diagram showing a control state at the start of a valve stop operation.

FIG. 9 is a diagram showing a control state at the start of a valve stop operation.

The valve stop operation is performed when, for example, an execution request of a predetermined valve stop operation such as a fuel cut request of the internal combustion engine 1 is detected by the ECU 26. Since such valve stop operation is an operation to displace the changeover pins 48, 54L, and 54R in their retreating direction by means of the slide pin 58 with the aid of the rotational force of the camshaft 12, such operation needs to be performed while the axial centers of these changeover pins 48, 54L, and 54R are positioned on the same straight line, that is, while the first rocker arm 32 is not oscillating.

As already described with reference to FIG. 7, in the present embodiment, the helical groove 64 is arranged such that the displacement section (section from S1 to S2) of the slide pin 58 in the retreating direction of changeover pins is within the base circle section. As a result of this, when the ECU 26 detects an execution request for a predetermined valve stop operation, with the solenoid 68 being driven in the order starting from a cylinder at which the base circle section first arrives, as shown in FIG. 9(B), the projection part 58*c* is inserted into the helical groove 64, thereby successively starting the valve stop operation of each cylinder. Then, as the projection part 58*c* which has been inserted into the helical groove 64 being guided by the helical groove 64, a slide operation of the slide pin 58 is started toward the displacement end Pmax2 side, as shown in FIG. 9(A), with the aid of the rotational force of the camshaft 12.

(At the Completion of Slide Operation)

Figure 10:
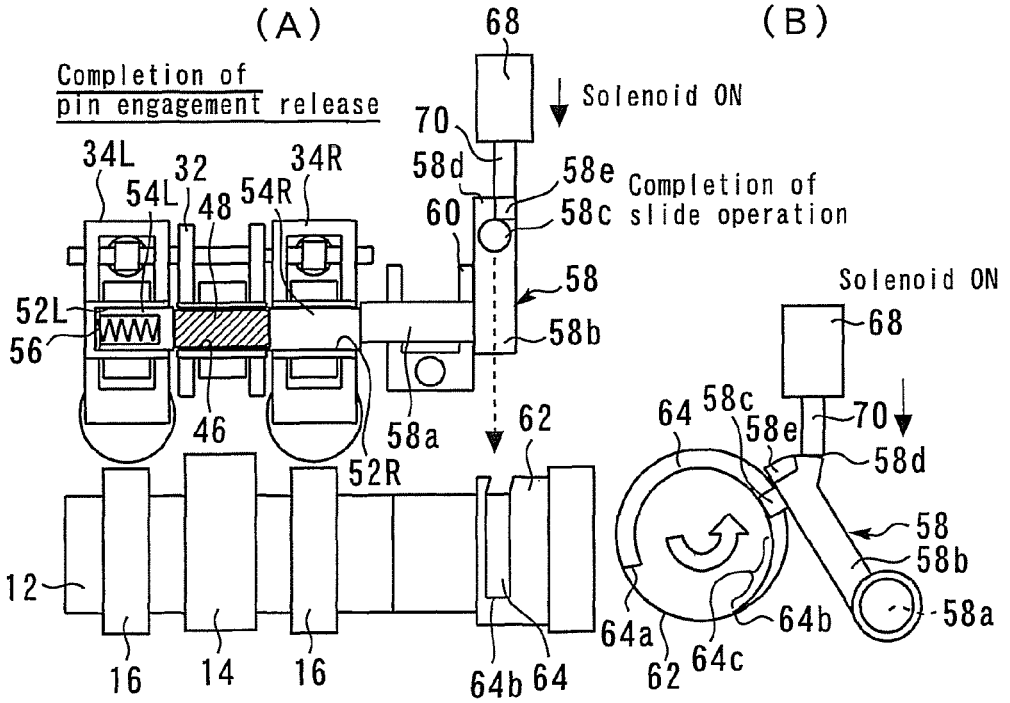
FIG. 10 is a diagram showing a control state at the completion of a slide operation.

FIG. 10 is a diagram showing a control state at the completion of the slide operation.

During the execution of the slide operation, the slide pin 58 moves toward the displacement end Pmax2, in a state in which the biasing force of the return spring 56 is received by the projection part 58*c* being in abutment with the side surface of the helical groove 64. FIG. 10(A) shows a timing at which the slide pin 58 has reached the displacement end Pmax2 and the slide operation at the time of a valve stop request is completed, that is, a timing at which the connection between the first rocker arm 32 and the second rocker arms 34R and 34L is released as a result of the first changeover pin 48 and the second changeover pin 54L becoming accommodated into the first pin hole 46 and the second pin hole 52L, respectively. Moreover, at this timing, as shown in FIG. 10(B), the position of the projection part 58*c* within the helical groove 64 has not yet reached the shallow groove part 64*c*.

When the slide operation is completed as shown above, and the first rocker arm 32 and the second rocker arms 34R and 34L become separated, the first rocker arm 32, which is biased by the coil spring 38 toward the main cam 14 as the main cam 14 rotates, comes to oscillate by itself. As a result of this, the acting force of the main cam 14 is not transferred to the two second rocker arms 34. Further, since the auxiliary cam 16, against which the second rocker arm 34 abuts, is a zero lift cam, the force for driving the valve 18 is no more provided to the second rocker arms 34, to which the acting force of the main cam 14 has come not to be transferred. As a result of that, since, regardless of the rotation of the main cam 14, the second rocker arm 34 comes into a stationary state, the lift operation of the valve 18 becomes halted.

Note that when only the first rocker arm 32 oscillates, the axial centers of the first changeover pin 48 and the second changeover pins 54L and 54R are deviated. In order to secure a smooth operation of first rocker arm 32 and the second rocker arms 34, a part of the end surfaces of the first changeover pin 48 and a part of the end surfaces of the second changeover pins 54L and 54R needs to be in abutment with each other when such a deviation occurs. For this reason, in the present embodiment, the shapes and sizes of the end surfaces of the first changeover pin 48 and the second changeover pins 54L and 54R are defined so as to satisfy the above-described condition.

(At the Time of Holding Operation of Displacement Member)

Figure 11:
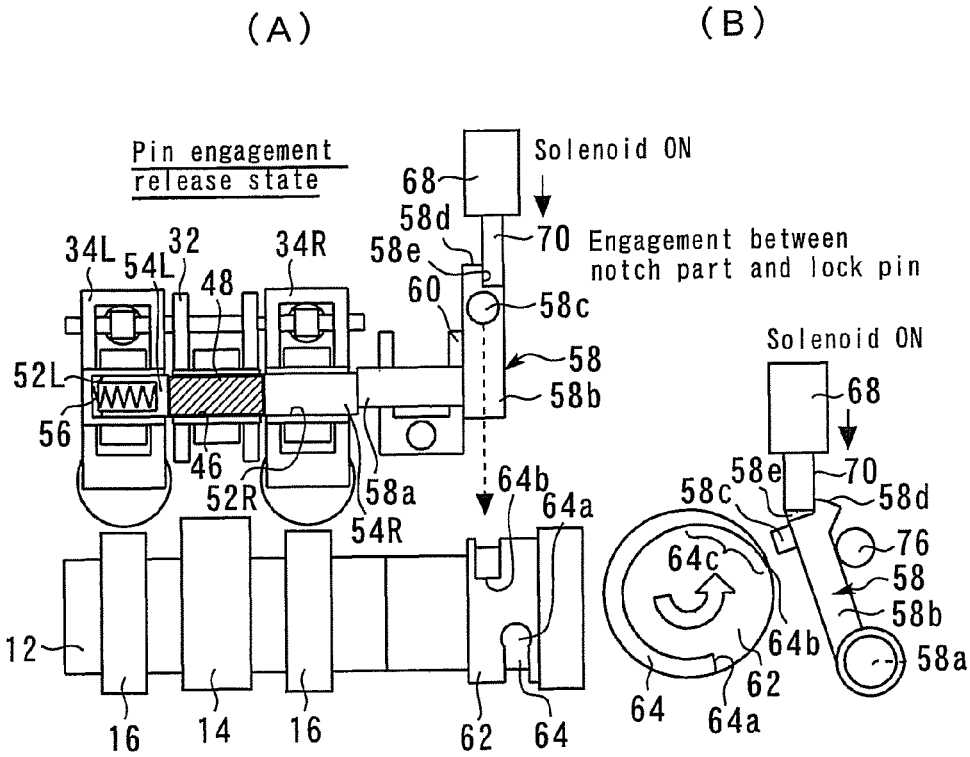
FIG. 11 is a diagram showing a control state at the time of holding operation to hold a slide pin with a lock pin.

FIG. 11 is a diagram showing a control state at the time of holding operation to hold the slide pin 58 with the lock pin 70.

When the camshaft 12 further rotates after the slide operation shown in above-described FIG. 10 is completed, the projection part 58*c* comes close to the shallow groove part 64*c* in which the depth of the groove gradually decreases. As a result of that, the action of the shallow groove part 64*c* causes the slide pin 58 to rotate in the direction separated from the camshaft 12. Then, as the depth of the groove decrease due to the shallow groove part 64*c*, the lock pin 70 is displaced a little in its retreating direction. Thereafter, when the slide pin 58 further rotates until the lock pin 70 which is constantly driven by the solenoid 68, coincides with the notch part 58*e*, the portion of the slide pin 58 side, which is to be abutment with the lock pin 70, is switched from the pressing surface 58*d* to the notch part 58*e*.

As a result of that, the lock pin 70 comes to be engaged with the notch part 58*e*. As a result of this, as shown in FIG. 11(B), the slide pin 58 comes to be held with the projection part 58*c* being separated from the camshaft 12, and with the biasing force of the return spring 56 being received by the lock pin 70. For this reason, in this holding operation, as shown in FIG. 11(A), the state in which the first rocker arm 32 and the second rocker arm 34 are separated, that is, the valve stop state is maintained.

(At the Time of Valve Return Operation)

A valve return operation for returning the operation from the valve stop state to a state in which the normal lift operation is performed is executed, for example, when an execution request of a predetermined valve return operation such as a request for returning from a fuel cut is detected by the ECU 26. Such valve return operation is started by the ECU 26 turning OFF the energization to the solenoid 68 at a predetermined timing, in a control state shown in FIG. 11. When the energization to the solenoid 68 is turned OFF, the engagement between the notch part 58*e* of the slide pin 58 and the lock pin 70 is released. As a result of that, the force to hold the first changeover pin 48 and the second changeover pins 54L respectively in the first pin hole 46 and the second pin hole 52L against the biasing force of the return spring 56 disappears.

Because of this, when the base circle section in which the positions of changeover pins 48, 54L, and 54R coincide arrives, the changeover pins 48 and 54L moves in the advancing direction by the biasing force of the return spring 56, thereby returning into a state in which the first rocker arm 32 and the two second rocker arms 34 are connected via the changeover pins 48 and 54L, that is, a state in which a lift operation of the valve 18 is enabled by the acting force of the main cam 14. Moreover, as the changeover pins 48 and 54L moves in the advancing direction by the biasing force of the return spring 56, the slide pin 58 is returned from the displacement end Pmax2 to the displacement end Pmax1 via the second changeover pin 54R.

Moreover, the above-described timing to turn OFF the solenoid 68 is a timing that is earlier than the start timing (Vc in FIG. 7) of the base circle section, in which the changeover pin 48 and the like are movable, by a predetermined time period needed for the operation of the solenoid 68. In the present embodiment, an arrangement is made such that when a request for starting the valve return operation is made, the energization of the solenoid 68 is turned OFF successively from the cylinder in which the above-described predetermined timing arrives. Moreover, the arrangement is also made such that when a request for starting the valve return operation is made, the energization of the solenoid 68 is immediately turned OFF for a cylinder which is within the lift section (the section in which only the first rocker arm 32 is oscillating) even if it is a cylinder for which the above-described timing has already passed. According to such a control, it is possible to make the changeover pin 48 and the like and the slide pin 58 ready to be moved immediately after the lift section in the abovementioned cylinder ends. Moreover, an arrangement is made such that when a request for starting the valve return operation is made, the energization of the solenoid 68 is turned OFF at a timing at which the above-described predetermined timing arrives at the next time, for a cylinder for which the above-described timing has already passed and which is within the base circle section.

In contrast to the arrangement of the above-described predetermined timing, when the timing to turn OFF the energization of the solenoid 68 is arranged within a base circle section immediately before the start of the lift section, a problem arises in that when the changeover pins 54L and 48 are about to be inserted respectively into the pin holes 46 and 52R in response to the turning OFF of the energization of solenoid 68, the oscillating operation of the first rocker arm 32 may have started resulting in that the changeover pins 54L and 48, which are in the course of being inserted, may be hit by the first rocker arm 32 and the second rocker arms 34R. In contrast to this, using the above-described predetermined timing makes it possible to perform the valve return operation securely while avoiding the above-described problem. Note that as the engine rotational speed increases, the crank angle change per unit time increases. Because of this, an arrangement is made such that the above-described predetermined timing is more advanced as the engine speed increases.

[Advantages of Valve Operating Apparatus of the First Embodiment]

According to the valve operating apparatus 10 of the present embodiment so far described, it becomes possible to switch the valve-open characteristics of the valve 18 between the normal lift operation state and the valve stop state by moving the axial position of the slide pin 58 between the displacement end Pmax1 and the displacement end Pmax2, with the aid of the ON and OFF of the energization of the solenoid 68, the rotational force of the camshaft 12, and the biasing force of the return spring 56.

To be more specific, when the valve stop request is made, by turning ON the energization of the solenoid 68 thereby inserting the projection part 58*c* into the helical groove 64, it is made possible to move the changeover pin 48 and the like in the retreating direction of changeover pin with the slide pin 58 which utilizes the rotational force of the camshaft 12. As a result of that, it becomes possible to quickly switch the first rocker arm 32 and the two second rocker arms 34 from a connected state to a disconnected state within one base circle section. This makes it possible to stop the lift operation of the valve 18. Moreover, when a valve return request is made, by turning OFF the energization of the solenoid 68 thereby releasing the engagement between the slide pin 58 and the lock pin 70, it is made possible to move the changeover pin 48 and the like and the slide pin 58 in the advancing direction of changeover pin, with the aid of the biasing force of the return spring 56. As a result of that, it becomes possible to quickly switch the first rocker arm 32 and the two second rocker arms 34 from the disconnected state to the connected state within one base circle section, and also to return the slide pin 58 to an original position (Pmax1) at which the valve stop operation can be started. This makes it possible to resume the lift operation of the valve 18.

Moreover, according to the above-described valve operating apparatus 10, by engaging the lock pin 70 with the notch part 58*e* after the slide pin 58 reaches the displacement end Pmax2 at which the slide operation of the slide pin 58 is completed, it becomes possible to transfer the function of holding the slide pin 58 such that it is not displaced from the displacement end Pmax2 to the displacement end Pmax1 side due to the biasing force of the return spring 56, from the side surface of the helical groove 64 which is engaged with the projection part 58*c* to the lock pin 70 which is engaged with the notch part 58*e*. The arrangement is, as already described, such that in a state in which the slide pin 58 is held by the engagement between the lock pin 70 and the notch part 58*e*, the projection part 58*c* is kept separated from the camshaft 12. By this arrangement, as a result of the holding of the slide pin 58 being changed to the lock pin 70 which is stationary with respect to the axial direction after the completion of the valve stop operation, it becomes possible to avoid the occurrence of friction and attrition in association with the sliding with the rotating camshaft 12. To be more specific, the elimination of friction allows an improvement of the fuel economy of the internal combustion engine 1. Further, the elimination of the attrition of the slide pin 58 allows the control positions of the changeover pin 48 and the like to be stabilized, thereby making it possible to ensure favorable switchability of the valve-open characteristics of the valve 18. In further addition, according to the configuration of the valve operating apparatus 10 of the present embodiment, the above-described holding function is realized between the lock pin 70 which operates integrally with the solenoid 68 which is provided for the purpose of inserting the projection part 58*c*, and the notch part 58*e* which is provided in the slide pin 58 which is provided for the purpose of moving the changeover pin 48 and the like. Therefore, it is possible to obtain the valve operating apparatus 10 which can favorably switch the valve-open characteristics of the valve 18 by using a simplified configuration, without leading to an increase in the number of components.

Further, as described above, the projection part 58*c* is held to be separated from the camshaft 12 by the lock pin 70 during the valve stop control. Therefore, at the time of the valve return operation, it becomes possible to resume the lift operation of the valve 18 by just turning OFF the energization of the solenoid 68 and through one direction and one step operation in the advancing direction of changeover pins as the operation of slide pin 58. As a result of this, according to the configuration of the above-described changeover mechanism 24, it is possible to favorably improve responsiveness of the valve return operation.

Moreover, a shallow groove part 64*c* in which the depth of groove gradually decreases is provided in the above-described helical groove 64. This makes it possible to detach the projection part 58*c* from the helical groove 64 with the aid of the rotational force of the camshaft 12 without needing other power after the end of displacement of the slide pin 58 in the retreating direction of changeover pin.

Further, the above-described helical groove 64 is arranged, as shown in FIG. 7, such that a major portion from the terminal end 64*b* side in the shallow groove part 64*c* in which the depth of the helical groove 64 gradually decreases, is positioned not in a base circle section but in a lift section. In this lift section, the first rocker arm 32 oscillates by being subjected to acting force of the main cam 14. As a result of that, the positions of the three changeover pins 48, 54L, and 54R are deviated from each other. Since, therefore, a part of the second changeover pin 54L which is subjected to the biasing force of the return spring 56 comes into contact not only with the first changeover pin 48 but also with the side surface of the first rocker arm 32, the biasing force of the return spring 56 becomes not be transferred to the slide pin 58. That is, according to the arrangement of the above-described helical groove 64, it is possible to securely avoid the projection part 58*c* being detached from the shallow groove part 64*c* due to the biasing force of the return spring 56, even when the depth of the groove gradually decreases in the process of the projection part 58*c* passing through the shallow groove part 64*c*. Thus, it is possible to favorably ensure the control stability of the valve-open characteristics of the valve 18.

Moreover, in the present embodiment, the changeover mechanism 24 is provided for each cylinder. This makes it possible to operate while switching optimum number of cylinders depending on, for example, the load of the internal combustion engine 1. Furthermore, when abnormality occurs in components of the changeover mechanism 24, such as a solenoid 68, in some cylinders, it becomes possible to perform an evacuation driving by arbitrarily operating the remaining cylinders.

Meanwhile, in the first embodiment, which has been described above, the arrangement is such that a notch part 58*e* is provided in the slide pin 58, and the slide pin 58 receives the biasing force of the return spring 56 with the engaging part between the notch part 58*e* and the lock pin 70 at the position separated from the camshaft 12. However, in the present invention, the engaging part which receives the biasing force exerted by biasing means is not limited to such embodiment. That is, for example, a notch part similar to the notch part 58*e* may be provided on the lock pin 70 side giving some consideration to the prevention of the rotation of the lock pin 70 so that the slide pin 58 can receive the biasing force of the return spring 56 at the position separated from the camshaft 12 at between itself and the arm part 58*b* of the slide pin 58.

Moreover, in the first embodiment, which has been described above, the arrangement of the helical groove 64 shown in FIG. 7 is made such that a major part from the terminal end 64*b* side in the shallow groove part 64*c* in which the depth of the helical groove 64 gradually decreases is positioned in the lift section. However, the present invention is not limited to such a configuration, and the arrangement may be such that the entire section of the shallow groove part is positioned in the lift section.

Note that in the first embodiment, which has been described above, the main cam 14 corresponds to the "cam" according to the first aspect of the present invention; the first rocker arm 24 and the second rocker arm 34 correspond to the "plurality of transfer members" according to the first aspect of the present invention; the ECU 26, the pin holes 46, 52L, and 52R, the changeover pins 48, 54L, and 54R, the return spring 56, the slide pin 58, the support member 60, the helical groove 64 of the large-diameter part 62, and the actuator 66 (the solenoid 68, the lock pin 70, the spring 72, and the support member 74) correspond to the "changeover means" according to the first aspect of the present invention; the changeover pins 48 and 54L correspond to the "changeover pin" according to the first aspect of the present invention; the return spring 56 corresponds to the "biasing means" according to the first aspect of the present invention; the slide pin 58 corresponds to the "displacement member" according to the first aspect of the present invention; the ECU 26, the slide pin 58, the support member 60, the helical groove 64 of the large-diameter part 62, and the actuator 66 (the solenoid 68, the lock pin 70, the spring 72, and the support member 74) correspond to the "pin driving mechanism" according to the first aspect of the present invention; and the engaging part between the notch part 58*e* of the slide pin 58 and the lock pin 70 corresponds to the "receiving part" according to the first aspect of the present invention.

Further, in the first embodiment, which has been described above, the first rocker arm 32 corresponds to the "first oscillation member" according to the second aspect of the present invention; the second rocker arm 34 corresponds to the "second oscillation member" according to the second aspect of the present invention; and the pin holes 46, 52L, and 52R correspond to the "engaging hole" according to the second aspect of the present invention.

Further, in the first embodiment, which has been described above, the fixed part between the solenoid 68 and the stationary member (cam carrier) of the internal combustion engine 1 correspond to the "fixed part" according to the third aspect of the present invention; the lock pin 70 corresponds to the "abutment part" according to the third aspect of the present invention; and the ECU 26 and the actuator 66 (the solenoid 68, the lock pin 70, the spring 72, and the support member 74) correspond to the "insertion control means" according to the third aspect of the present invention.

Further, in the first embodiment, which has been described above, the lock pin 70 corresponds to the "abutment pin" according to the fifth aspect of the present invention.

Second Embodiment

Next, a second embodiment of the present invention will be described with reference to FIG. 12.

It is supposed that the configuration of the valve operating apparatus 10 of the present embodiment is similar to the valve operating apparatus 10 of the first embodiment described above except that the arrangement of a helical groove 80 provided in the large-diameter part 62 of the camshaft 12 is different from the arrangement of the helical groove 64 shown in above-described FIG. 7.

Figure 12:
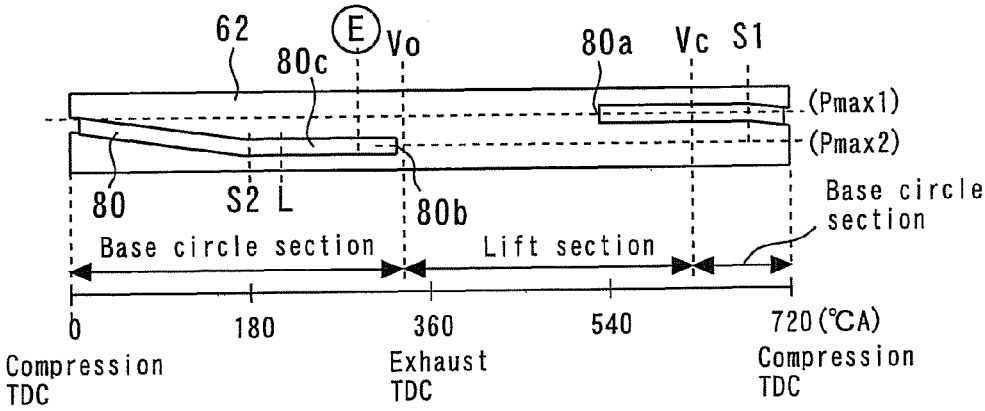
FIG. 12 is a development view to illustrate the arrangement of the helical groove in the second embodiment of the present invention.

FIG. 12 is a development view to illustrate the arrangement of the helical groove 80 in the second embodiment of the present invention.

In the first embodiment described above, as shown in above-described FIG. 7, the helical groove 64 is arranged such that a major part from the terminal end 64*b* side in the shallow groove part 64*c* in which the depth of the helical groove 64 gradually decreases is positioned in the lift section. Then, a timing E, that is, a timing at which the function of holding the slide pin 58 against the biasing force of the return spring 56 is fully transferred from the helical groove 64 to the lock pin 70, is arranged within the lift section. According to such arrangement, the projection part 58*c* of the slide pin 58, which has been guided by the helical groove 64 to thereby be displaced from the displacement end Pmax1 to the displacement end Pmax2, is taken out from the helical groove 64 within the lift section by the action of the shallow groove part 64*c*.

In contrast to this, in the arrangement of the helical groove 80 shown in FIG. 12, a section, in which a shallow groove part 80*c* is provided, is arranged within the base circle section along with the displacement section (section from S1 to S2) of the slide pin 58. Accordingly, the above-described timing E is arranged within the base circle section as well. According to such arrangement, the projection part 58*c* of the slide pin 58 which has been guided by the helical groove 80 to thereby be displaced from the displacement end Pmax1 to the displacement end Pmax2 is taken out from the helical groove 80 within the base circle section through the action of the shallow groove part 80*c*.

When the valve return request is made immediately after the valve stop operation is started upon receipt of a valve stop request, in the arrangement of the first embodiment described above, since the projection part 58*c* is taken out within the lift section, the valve return operation is performed in the next round of the base circle section. As a result of this, even when a valve stop request is canceled immediately after it is issued, the lift operation of the valve 18 is stopped for one cycle and thereafter the lift operation of the valve 18 is restarted from the next round of lift section.

In contrast to this, according to the arrangement of the present embodiment shown in FIG. 12, since the projection part 58*c* can be taken out from the helical groove 80 within the base circle section where the slide pin 58 is being displaced in response to a valve stop request, it becomes possible to return the rocker aims 32 and 34 into the connected state reflecting the valve return request within the base circle section. That is, according to the arrangement of the helical groove 80 of the present embodiment, when a valve return request is issued immediately after a valve stop request is issued, it becomes possible to quickly cancel the valve stop request without stopping any single lift operation of the valve 18.

Third Embodiment

Next, a third embodiment of the present invention will be described with reference to FIGS. 13 and 14.

The configuration of the valve operating apparatus 10 of the present embodiment is supposed to be the same as the valve operating apparatus 10 of the first embodiment described above except that the configuration of the engaging part between a notch part 90*e* of a slide pin 90 and a lock pin 92 is different.

Figure 13:
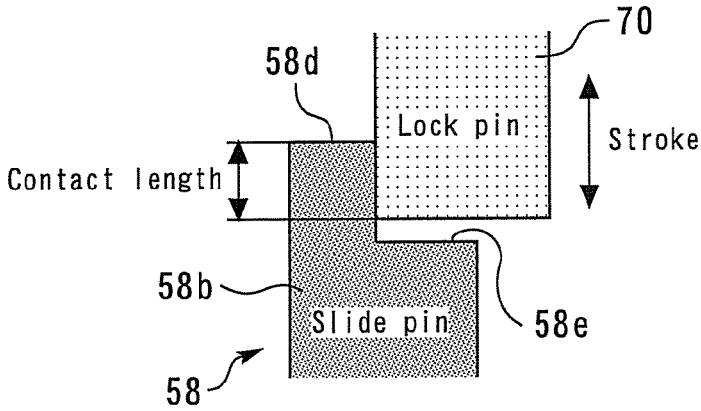
FIG. 13 is an enlarged view of the engaging part of the first embodiment which is referred for the comparison with the configuration of the third embodiment of the present invention.

FIG. 13 is an enlarged view of the engaging part of the first embodiment which is referred for the comparison with the configuration of the third embodiment of the present invention.

The configuration shown in FIG. 13 is arranged such that the inner side surface of the notch part 58*e* of the slide pin 58 is engaged with a peripheral surface of the lock pin 70 having a single diameter. Two types of performances are required of such engagement. That is, the first is the performance to receive and hold the slide pin 58 against the biasing force of the return spring 56, and the second is a good response performance when the lock pin 70 is withdrawn from the engaging part.

It is possible to satisfy the first performance even by the configuration shown in above-described FIG. 13. However, in this configuration, since the inner side surface of the notch part 58*e* and the peripheral surface of the lock pin 70 are in line contact, the effect of friction becomes relatively large when the lock pin 70 is withdrawn. Because of this, the responsiveness at the time of withdrawal of the lock pin 70 is not good and there is a concern that the variation of response increases. Moreover, by increasing the biasing force of the above-described spring 72 to bias the lock pin 70 in the retreating direction, it is possible to improve the responsiveness when the lock pin 70 retreats. However, the electric power of the solenoid 68 to hold the lock pin 70 in an advanced state during the holding operation of the slide pin 58 increases.

Figure 14:
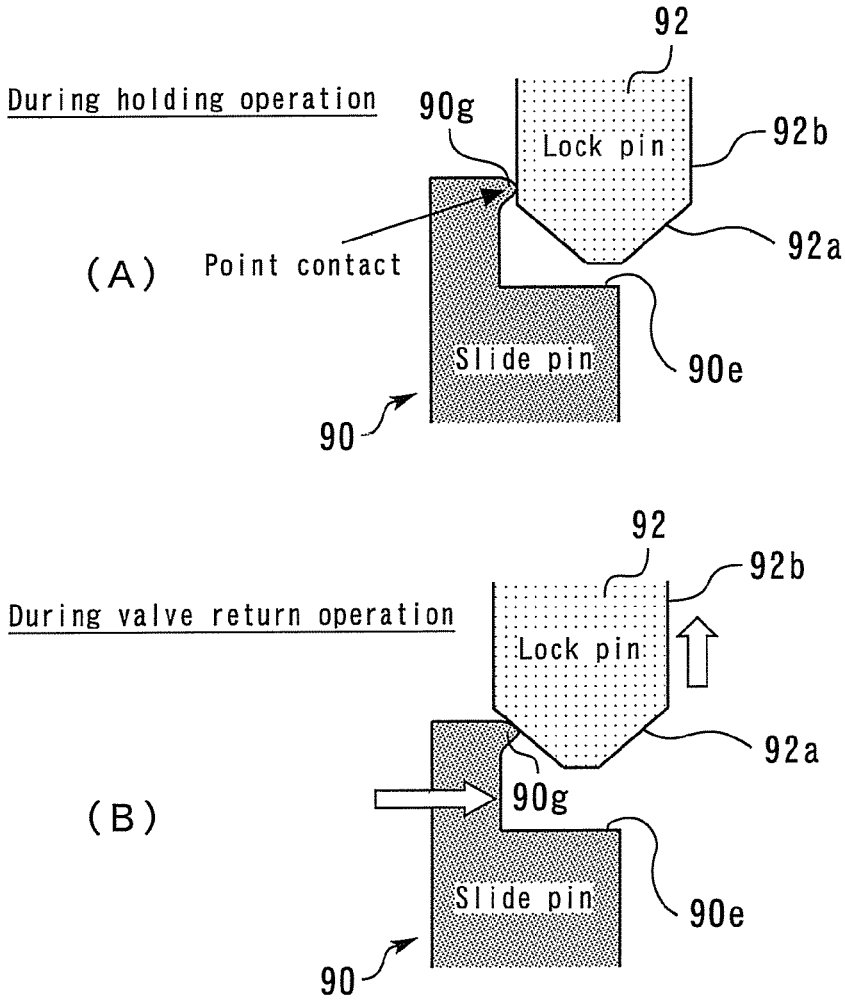
FIG. 14 is a diagram showing the configuration of engaging part in the third embodiment of the present invention.

FIG. 14 is a diagram showing the configuration of the engaging part in the third embodiment of the present invention. To be more specific, FIG. 14(A) shows the relationship at the time of holding operation of the slide pin 90 where the lock pin 92 is sufficiently engaged in the notch part 90*e* of the slide pin 90, and FIG. 14(B) shows the relationship during the valve return operation, to be more specific, during the execution of the operation by which the lock pin 92 is detached from the notch part 90*e*.

As shown in FIG. 14, a contact part 90*g*, which is to be in contact with the lock pin 92 and is formed in the inner side surface of the notch part 90*e*, is formed into an R-shape section which is convex toward the counterpart (lock pin 92) side. On the other hand, a tapered part 92*a* which is formed into a tapered shape which becomes thinner toward the distal end is provided in the distal end of the lock pin 92. Note that, the radius R of the section of the contact part 90*g* may be either a simplex one or a complex one.

Further, in the present embodiment, as shown in FIG. 14(A), an arrangement is made such that at the time of holding operation of the slide pin 90, the contact part 90*g* is in contact with a straight part 92*b*, which has a single radius, in the lock pin 92. Moreover, an arrangement is made such that as shown in FIG. 14(B), when a valve return request is made and the operation in which the lock pin 92 is detached from the notch part 90*e* proceeds, the portion of the lock pin 92 which is in contact with the contact part 90*g* is changed from the straight part 92*b* to the tapered part 92*a*.

According to the configuration shown in FIG. 14 described so far, the contact part 90*g* provided in the notch part 90*e* is formed into an R-shape section which is convex toward the counterpart side. Since, as a result of this, the contact part 90*g* and the lock pin 92 come into point contact, it is possible to reduce the friction when withdrawing the lock pin 92 during the valve return operation. For this reason, it is possible to favorably ensure the responsiveness when withdrawing the lock pin 92, and also to reduce the variation of response.

Moreover, according to the configuration shown in above-described FIG. 14, since the distal end of the lock pin 92 is tapered, at the time of the valve return shown in FIG. 14(B), it becomes possible to assist the spring 72 (see FIG. 5) which biases the lock pin 92 in its retreating direction with the aid of the load of the slide pin 90 which is subjected to the biasing force of the return spring 56. This makes it possible to favorably improve the responsiveness when withdrawing the lock pin 92. Moreover, since such assistance is made possible, the spring force of the spring 72 may be arranged at a lower value, thereby reducing the power consumed by the solenoid 68 during the holding operation of the slide pin 90.

Further, according to the configuration shown in above-described FIG. 14, an arrangement is made such that the contact part 90*g* is in contact with the straight part 92*b* of the lock pin 92 at the time of the holding operation of the slide pin 90. As a result of this, compared with a case in which the contact part 90*g* is kept in contact with the tapered part 92*a* at the time of the holding operation, it is possible to reduce the power consumption of the solenoid 68 at the time of the holding operation, and also to quickly withdraw the lock pin 92 with the aid of the tapered part 92*a* as described above at the time of the valve return.

Meanwhile, although, in the first to third embodiments, which has been described above, description has been made on an example in which the auxiliary cam 16 is configured to be a zero-lift cam, the auxiliary cam in the present invention is not limited to a zero-lift cam, and may be a cam including a nose part for transferring acting force to the second rocker arm 34.

The invention claimed is:

1. A valve operating apparatus for an internal combustion engine, comprising:

a variable mechanism which is disposed between a cam and a valve, includes a plurality of transfer members for transferring an acting force of the cam to the valve, and changes valve-opening characteristics of the valve as the plurality of transfer members are connected/disconnected to/from each other; and a changeover device which switches the connection/disconnection of the plurality of transfer members, wherein the changeover device includes:

a changeover pin which is advanceably and retreatably attached to the variable mechanism and makes the plurality of transfer members connected to or disconnected from each other;

a biasing device which biases the changeover pin in an advancing direction thereof; and a pin driving mechanism which includes a displacement member that is displaceable in association with a advancing/retreating operation of the changeover pin and receives a biasing force exerted by the biasing device via the changeover pin, wherein the pin driving mechanism displaces the changeover pin in a retreating direction thereof via the displacement member with an aid of a rotational force of the cam, and wherein the pin driving mechanism further includes a receiving part which receives a biasing force of the biasing device acting on the changeover pin, in a state of being separated from a rotating body which rotates in association with the cam, when the displacement member has reached a displacement end in the retreating direction of the changeover pin.

2. The valve operating apparatus for the internal combustion engine according to claim 1, wherein the plurality of transfer members includes a first oscillation member which is caused to oscillate by the cam, and a second oscillation member which oscillates in association with the valve, and wherein the changeover pin is advanceably and retreatably supported by one of the first oscillation member and the second oscillation member, and is inserted into and taken out from an engaging hole provided in the other of the first oscillation member and the second oscillation member.

3. The valve operating apparatus for the internal combustion engine according to claim 1, wherein the pin driving mechanism further includes:

a helical groove which is formed in an outer peripheral surface of the rotating body which rotates in association with the cam and guides a displacement of the displacement member;

a projection part which is provided in the displacement member and is insertable into and removable from the helical groove; and an insertion control device which includes a fixed part fixed to a stationary member of the internal combustion engine, and an abutment part abuttable to the displacement member, and inserts the projection part into the helical groove by abutting the abutment part to the displacement member, and wherein the receiving part is provided between the displacement member and the abutment part.

4. The valve operating apparatus for the internal combustion engine according to claim 3, wherein the projection part moves away from the rotating body in response to engagement between the displacement member and the abutment part when the displacement member reaches the displacement end.

5. The valve operating apparatus for the internal combustion engine according to claim 3, wherein the abutment part is an abutment pin which is abuttable to the displacement member, wherein the displacement member includes a notch part which is positioned opposed to the abutment pin when the displacement member reaches the displacement end, and wherein the receiving part is an engaging part between the abutment pin and the notch part.

6. The valve operating apparatus for the internal combustion engine according to claim 3, wherein the helical groove includes a shallow groove part in which a depth of the helical groove gradually decreases as the rotating body rotates after the displacement member, which is guided by the helical groove, reaches the displacement end.

7. The valve operating apparatus for the internal combustion engine according to claim 6, wherein the shallow groove part is arranged such that at least a partial section from a terminal end of the shallow groove part or an entire section of the shallow groove part is positioned within a non-base-circle section of the cam.

8. The valve operating apparatus for the internal combustion engine according to claim 6, wherein the shallow groove part is arranged such that a terminal end of the shallow groove part corresponds to a base circle section of the cam.

9. The valve operating apparatus for the internal combustion engine according to claim 5, wherein a sectional shape of a contact part of the notch part which is in contact with the abutment pin has an R-shape section which is convex toward the abutment pin side.

10. The valve operating apparatus for the internal combustion engine according to claim 5, wherein the abutment pin is formed into a tapered shape which becomes thinner toward a distal end thereof.

11. The valve operating apparatus for the internal combustion engine according to claim 10, wherein the contact part engages with a non-tapered part of the abutment pin when a state in which the biasing force exerted by the biasing means is received between the contact part and the abutment pin is held and, on the other hand, the contact part engages with the tapered part of the abutment pin after an operation to release the engagement between the abutment pin and the notch part is started.

* * * * *

UNITED STATES PATENT AND TRADEMARK OFFICE

CERTIFICATE OF CORRECTION

PATENT NO. : 8,251,028 B2
APPLICATION NO. : 12/677622
DATED : August 28, 2012
INVENTOR(S) : Suichi Ezaki et al.

It is certified that error appears in the above-identified patent and that said Letters Patent is hereby corrected as shown below:

| Column | Line | |
|---|---|---|
| 19 | 61 | Change “rocker aims 32” to --rocker arms 32--. |

Signed and Sealed this
Fifteenth Day of January, 2013

David J. Kappos

David J. Kappos
*Director of the United States Patent and Trademark Office*